United States Patent [19]

Flax

[11] 3,941,269

[45] Mar. 2, 1976

[54] BOTTLE CAPSULES

[76] Inventor: Valer Flax, Place Mahomme, 32190 Vic-Fezensac, France

[22] Filed: Mar. 27, 1974

[21] Appl. No.: 455,044

[52] U.S. Cl. ..... 215/246; 53/39; 53/42; 156/86

[51] Int. Cl.[2] ..... B65D 41/54

[58] Field of Search ..... 215/246, 319; 206/803, 206/497, 408, 519; 229/DIG. 11; 53/39, 42; 156/86

[56] References Cited

UNITED STATES PATENTS

| | | | |
|---|---|---|---|
| 825,116 | 3/1906 | Engels | 206/497 |
| 1,937,468 | 11/1933 | Talbot | 206/497 |
| 2,121,041 | 6/1938 | Morgan | 215/246 |
| 2,497,870 | 2/1950 | Dennis | 206/508 |

FOREIGN PATENTS OR APPLICATIONS

| | | | |
|---|---|---|---|
| 1,103,200 | 2/1968 | United Kingdom | 215/246 |
| 898,403 | 11/1953 | Germany | 215/246 |

*Primary Examiner*—George T. Hall
*Attorney, Agent, or Firm*—Hane, Baxley & Spiecens

[57] ABSTRACT

There is disclosed a capping capsule for sealing attachment to the neck portion of a container such as a bottle. The capsule consists of a base wall portion in the form of a planar disc from which extends integral with the disc a heat shrinkable tubular side wall portion of substantially uniform thickness. The planar disc is thicker than the tubular side wall portion and the peripheral outline of the base wall is smaller than the inner peripheral outline of the side wall portion.

4 Claims, 4 Drawing Figures

BOTTLE CAPSULES

The present invention is concerned with capping capsules for capping bottles.

The present invention is also concerned with a process of producing capping capsules as well as apparatus for carrying out the process.

Known capping capsules in shrinkable skin-like material have been made by assembling a shrinkable tubular part with a plate or lozenge of non-shrinkable material serving as a cap or base of the capsule.

In certain constructions, this plate was not fast with the tubular body being held in place only by the turned-over edge of the tubular body. In other arrangements, this plate was held in place by adhesive which produced an uncertain assembly given that the material of the plate was not shrinkable at the junction with the body which, when heated to obtain shrinkage on the neck of a bottle, had to shrink freely, this shrinkage upon heating occuring very suddenly and producing a substantial change in the initial profile.

The diameter of the plate in these known arrangements was substantially the same as the initial diameter of the tubular body after shrinkage and because the plates were made of non-shrinkable material, they prevented the tubular bodies shrinking sufficiently at the level of the plate at the time of final shrinkage on the neck of the bottle, the plate opposing shrinkage across its diameter, remaining unchanged because of its inability to shrink, remaining too large, and the shrinkage of the tubular body on the bottle being thus insufficient particularly at the region where complete sealing is required; that is to say at the extremity of the neck of the bottle.

The object of the invention is to avoid these difficulties by providing shrinkable capping capsules made of a single piece as will hereinafter be described and illustrated in the annexed drawings by way of nonlimiting example.

IN THE DRAWINGS.

Figure 2:
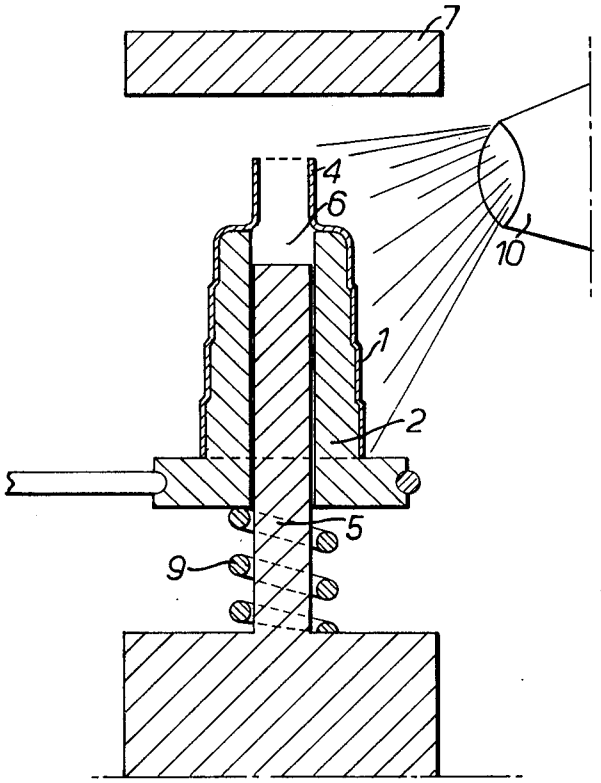
FIG. 2 is a sectional view similar to FIG. 1 showing the device in an advanced operational stage.
Figure 1:
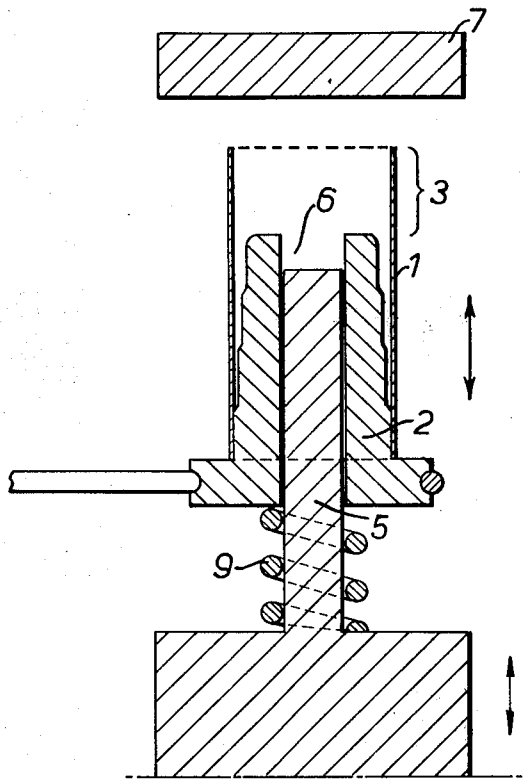
FIG. 1 is an elevational sectional view of a device according to the invention shown in its first operational stage.
Figure 4:
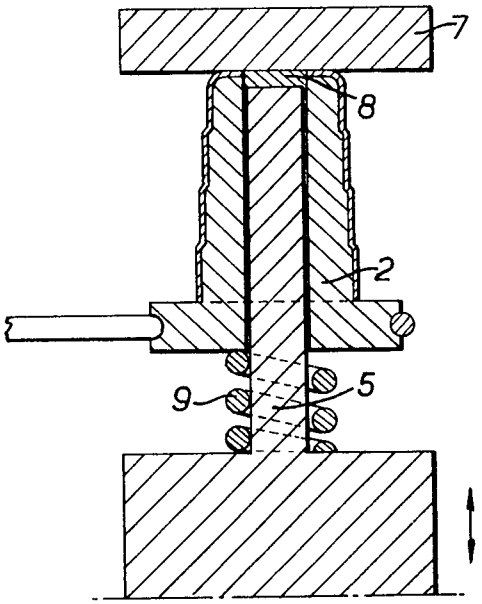
FIG. 4 shows the device in its final stage in which the cap is finished.

According to one embodiment, a shrinkable tubular sheath 1, for example of polyvinyl or polystyrene material, is radially distended during its extrusion when a rough starting piece having a very small initial diameter at the exit of an extrusion die will have been distended to obtain a diameter several times larger in the rigid state of the shrinkable extruded sheath.

To form a capping capsule a cut piece of the shrinkable sheath is threaded on to a mandrel 2, the length of the piece being such that the piece extends beyond the free end of the mandrel. The tubular piece is then heated in the region extending beyond the mandrel to cause shrinkage under the effect of heating, the part 3 thus shrunk adopting the form of a cylindrical chimney 4 having again the small diameter such as it had at the exit of the extrusion die before distention of the sheath.

The mandrel which has a bore as illustrated in FIGS. 1, 2, 3, 4 comprises a piston 5 movable axially of the mandrel, the extremity of the piston at the beginning of the operation (FIG. 1) being withdrawn relative to the extremity of the mandrel so as to leave, at this stage, a hollow space 6.

The extremity of the heated sheath having taken the form of a chimney 4 of small diameter as above described, is then pressed into the hollow space 6 of the mandrel 2.

The material of this chimney being heated is softened, allowing the material to be rammed into the hollow space of the mandrel (FIG. 3) after which the piston 5 is advanced in the mandrel to press the turned-in material against a fixed abutment 7 facing the mandrel, this abutment, in the pressing position, forming in co-operation with the extremity of the mandrel a sealed chamber, preventing the softened material pressed by the advancing piston, from escaping.

The soft material, thus heavily compressed between the abutment and the piston, will entirely fill the chamber and will take the form of a disc or lozenge 8 which forms the base of the capping capsule, this disc being very homogeneous due to the pressure, being fomred of the same material as the cylindrical wall of the capsule, having never been detached therefrom and the final article being monolithic having its wall and base forming a single piece.

The part of the tubular piece extending beyond the mandrel and forming by shrinkage the chimney is of a length such that the mass of its material is sufficient to form the lozenge constituting the base of the capsule.

The diameter of the chimney being much less than the diameter of the cylindrical body of the tubular part which is threaded on the mandrel, the diameter of the base of the capsule or lozenge which will be formed from the chimney, will be much less than the diameter of the tubular body of the finished capsule. At the time of shrinkage of the capping capsule placed on the neck of a bottle, the shrinkage will not be opposed by the existence of the base which will not prevent the adhesion to the neck of the retracted capsule thereby providing excellent sealing.

In another embodiment of the invention a plain sheet of bi-axially oriented thermoplastic material such as PVC plasticised or not or of any other suitable plastic material providing heat shrinkage of the order of at least 12% may be used as the starting material.

This sheet is profiled to form a hollow cup of small depth which may be less than 20 mm. This forming can be carried out, because of the small depth, either by classic cold stamping or by vacuum forming.

The base of the capsule will form with the lateral wall of the tubular part of the cup a single piece. This capsule placed on the neck of a bottle will, upon reheating, freely shrink. It will strongly grip the neck of the bottle given that the base of the cup forming the capping capsule is itself also formed of material shrinkable to the same degree as the tubular part. No plate of non-shrinkable material being incorporated, the shrinkage of the capsule will not be impeded at any time, thereby providing a very strong adhesion to the neck of the bottle following perfect reduction in the diameter of the tubular part.

In limiting the depth of the cup at the time of stamping the sheath, it is possible to determine in advance with great precision the degree of shrinkage of the capsule in the direction of its depth to determine its height after heating to shrink it onto the neck of the bottle because the drawing in depth of the sheet confers on it a shrinkage in the third dimension, the sheet used being already bi-axially oriented at the start.

The apparatus for producing the capping capsule illustrated in FIGS. 1 to 4 comprises a cylindrical mandrel 2 axially movable on a piston 5 in a central bore of the mandrel. The base of the mandrel rests on a resilient element 9, for example a spring bearing on an annular shoulder of the piston. This also is movable in an axial direction by mechanical hydraulic or pneumatic means.

Laterally of the mandrel is at least one heating device 10 preferably an air heater (FIG. 2).

Figure 3:
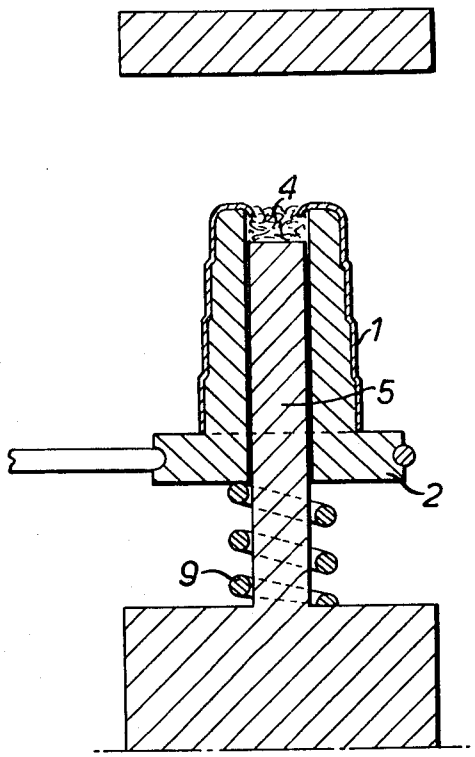
FIG. 3 shows the device in a further advanced stage.

An abutment 7 is located in front of the mandrel. A piece 1 cut from a shrinkable sheath is threaded onto the mandrel the piece projecting beyond the end of the mandrel. The whole of the cut sheath of which the part 3 extends beyond the mandrel is heated and shrinks under the effect of heating. The shrunk piece forms a cylindrical chimney 4 having again the small diameter such as it had at the exit of the extrusion die before distention of the sheath. This chimney is turned back into the space defined by the hollow mandrel and piston whose extremity at this point is retracted relative to the extremity of the mandrel (FIG. 3). Advantageously the mandrel is rotated to ensure uniform heating.

The penetration of the softened chimney 4 into the hollow space of the mandrel will be effected by applying a pressure which, for example, will be laterally directed.

A vertical sheet may be moved past the mandrel carrying the sheath, at the base of the softened chimney while this is rotated, in advancing this sheet makes rubbing engagement against the wall of the chimney causing a shortening of the chimney by formation of a twist which carries the material of the chimney into the hollow of the mandrel.

According to one embodiment of the process according to the invention, one can cause the chimney to enter the hollow space by suction.

The softened turned-in material of the chimney will be compressed by the piston 5 which advances in the mandrel to press the material against the fixed abutment opposite the mandrel 2. This abutment 7 in the pressing position forms in co-operation with the extremity of the mandrel a sealed chamber which prevents the softened material pressed by the piston from escaping from the mandrel which itself is subjected to the pressure of a resilient element, for example a spring, which urges it strongly against the abutment.

In the case of the embodiment of the invention where the starting material is a plain sheet of shrinkable material profiled by stamping or thermo-forming to provide one or more cups or sockets, the depth of the socket will be determined so that the shrinkage in depth (or shrinkage of the height of the tubular wall) will be less than the radial shrinkage. The less the socket is deep, the less the shrinkage will appear in the direction of the depth. This is important, having regard to the fact that this type of capsule is provided primarily to ensure the tightening of a synthetic plastics cork under the capsule and having regard to the fact that the height of this capsule must be calculated so that it grips the rim of the bottle. From this fact the radial shrinkage must be greater than that of the length of the wall.

Capsules as above described can be used for all capping operations and they provide a particularly efficient capping.

It is to be noted that the mandrel illustrated in the drawings is stepped downwards in diameter in the direction of the free end of the mandrel. The purpose of this arrangement is to improve the strength of the capsule which, if it were purely cylindrical and being of thin material, would be extremely fragile and difficult to handle. By providing the changes in diameter, so to speak in cascade towards the end of the capsule which will be closed, the fragility of the article is substantially reduced because pressure in an axial direction to which a pile of these elements may be subjected is supported by the annular zones individually each being less in length than the total length of a capsule.

I claim:

1. A capping capsule made of a synthetic plastics material for sealing attachment to the neck portion of a container, said capsule comprising: a base wall portion in the form of a planar disc; and a heat-shrinkable tubular side wall portion having a substantially uniform wall thickness extending from the periphery of the base wall portion integral therewith and made of the same material as the base wall portion, the base wall portion being thicker than the tubular side wall portion and having a peripheral outline smaller than the peripheral outline of the interior of the side wall portion.

2. The capping capsule according to claim 1 wherein said base wall portion is made of a non-shrinkable material.

3. The capsule according to claim 1 wherein said tubular side wall portion comprises lengthwise spaced peripheral steps.

4. The capsule according to claim 3 wherein said steps are radially increased toward the end of the tubular side wall portion.

* * * * *